US005523189A

United States Patent [19]

Molaire

[11] Patent Number: 5,523,189

[45] Date of Patent: Jun. 4, 1996

[54] ELECTROPHOTOGRAPHIC RECORDING ELEMENTS AND PREPARATION METHOD

[75] Inventor: Michel F. Molaire, Rochester, N.Y.

[73] Assignee: Eastman Kodak Company, Rochester, N.Y.

[21] Appl. No.: 330,297

[22] Filed: Oct. 27, 1994

[51] Int. Cl.[6] ..... G03G 5/08

[52] U.S. Cl. ..... 430/58; 430/78

[58] Field of Search ..... 430/78, 58; 252/501.1; 106/411

[56] References Cited

U.S. PATENT DOCUMENTS

| | | | |
|---|---|---|---|
| 3,615,414 | 10/1971 | Light . | |
| 4,175,960 | 11/1979 | Berwick et al. . | |
| 4,514,481 | 4/1985 | Scozzafava et al. . | |
| 4,578,334 | 3/1986 | Borsenberger et al. . | |
| 4,666,802 | 5/1987 | Hung et al. . | |
| 4,701,396 | 10/1987 | Hung et al. . | |
| 4,719,163 | 1/1988 | Staudenmayer et al. . | |
| 4,882,427 | 11/1989 | Enokida et al. . | |
| 4,994,566 | 2/1991 | Mimura et al. . | |
| 5,008,173 | 4/1991 | Mimura et al. . | |
| 5,039,586 | 8/1991 | Itami et al. . | |
| 5,055,368 | 10/1991 | Nguyen et al. . | |
| 5,059,355 | 10/1991 | Ono et al. . | |
| 5,106,536 | 4/1992 | Miyamoto et al. | 430/78 |
| 5,112,711 | 5/1992 | Nguyen et al. . | |
| 5,132,197 | 7/1992 | Iuchi et al. . | |
| 5,153,094 | 10/1992 | Kazmaier et al. . | |
| 5,166,339 | 11/1992 | Duff et al. . | |
| 5,182,382 | 1/1993 | Mayo et al. . | |
| 5,194,354 | 3/1993 | Takai et al. . | |
| 5,206,359 | 4/1993 | Mayo et al. . | |
| 5,238,764 | 8/1993 | Molaire et al. . | |
| 5,238,766 | 8/1993 | Molaire et al. . | |

OTHER PUBLICATIONS

P. M. Borsenberger et al., *Organic Photoreceptors for Imaging System*, Marcel Dekkar, Inc., New York, pp. 338–391.

*Primary Examiner*—Christopher D. Rodee
*Attorney, Agent, or Firm*—John R. Everett

[57] ABSTRACT

An electrophotographic element and a preparation method. The element has a charge generation layer including binder and, dispersed in the binder, a physical mixture of: a high speed titanyl fluorophthalocyanine and a low speed titanyl fluorophthalocyanine. The high speed titanyl fluorophthalocyanine has a first intensity peak with respect to X-rays characteristic of Cu Kα at a wavelength of 1.541 Å of the Bragg angle 2θ at 27°±0.2° and a second intensity peak at 7.3°±0.2°. The second peak has an intensity relative to the first peak of less than 60 percent. The low speed titanyl fluorophthalocyanine has a first intensity peak with respect to X-rays characteristic of Cu Kα at a wavelength of 1.541 Å of the Bragg angle 2θ at 6.7°±0.2° and a second intensity peak at 23.7°±0.2. The second peak has an intensity relative to the first peak of less than 50 percent.

12 Claims, 2 Drawing Sheets

ELECTROPHOTOGRAPHIC RECORDING ELEMENTS AND PREPARATION METHOD

FIELD OF THE INVENTION

The invention relates to electrophotographic elements and preparation methods. The invention more particularly relates to electrophotographic elements having a charge generation layer including binder and, dispersed in the binder, a physical mixture of: a high speed titanyl fluorophthalocyanine and a low speed titanyl fluorophthalocyanine and preparation methods.

BACKGROUND OF THE INVENTION

In electrophotography an image comprising a pattern of electrostatic potential (also referred to as an electrostatic latent image), is formed on a surface of an electrophotographic element comprising at least two layers: a photoconductive layer and an electrically conductive substrate. The electrostatic latent image can,be formed by a variety of means, for example, by imagewise radiation-induced discharge of a uniform potential previously formed on the surface. Typically, the electrostatic latent image is then developed into a toner image by contacting the latent image with an electrographic developer. If desired, the latent image can be transferred to another surface before development.

Among the many different kinds of photoconductive materials which have been employed in electrophotographic elements are phthalocyanine pigments such as titanyl phthalocyanine and titanyl tetrafluorophthalocyanine. These materials are generally insoluble; thus, photoconductive layers are usually produced from a liquid coating composition which includes a dispersion of the titanyl phthalocyanine pigment and a solvent solution of a polymeric binder. The titanyl phthalocyanine pigment is first prepared to convert it to a form, either crystalline or amorphous, that is highly photoconductive and capable of being sufficiently and stably dispersed in the coating composition to permit its being applied at a low enough concentration to form a very thin layer having high electrophotographic speed in the near infrared range.

A variety of methods have been used to produce suitable forms of titanyl phthalocyanine. Different methods have commonly produced titanyl phthalocyanines having differing crystallographic and electrophotographic characteristics. Many types of TiOPc and other phthalocyanines are discussed in *Organic Photoreceptors for Imaging Systems,* P. M. Borsenberger and D. S. Weiss, Marcel Dekkar, Inc., New York, pp. 338–391.

In one group of preparations, commonly referred to as "acid-pasting", crude titanyl phthalocyanine is dissolved in an acid solution, which is then diluted with non-solvent to precipitate the titanyl phthalocyanine product. In another group of preparations, the! crude titanyl phthalocyanine is milled, generally with particular milling media. Some preparations combine techniques or modify a previously prepared titanyl phthalocyanine.

U.S. Pat. Nos. 4,701,396; 5,153,094; 5,166,339; and 5,182,382 teach various acid pasting methods. U.S. Pat. No. 5,132,197, to Iuchi et al, teaches a method in which titanyl phthalocyanine was acid pasted, treated with methanol, and milled with ether, monoterpene hydrocarbon, or liquid paraffin. U.S. Pat. No. 5,206,359, to Mayo et al, teaches a process in which titanyl phthalocyanine produced by acid pasting is converted to type IV titanyl phthalocyanine from type X by treatment with halobenzene. U.S. Pat. No. 5,059, 355, to Ono et al, teaches a process in which α- or β-TiOPc was shaken with glass beads producing an amorphous material having no substantial peaks by X-ray diffraction. The amorphous material was stirred with heating in water and ortho-dichlorobenzene, Methanol was added after cooling. U.S. Pat. No. 5,194,354, to Takai et al, teaches that amorphous titanyl phthalocyanine prepared by dry pulverization or acid pasting can be converted, by stirring in methanol, to a low crystalline titanyl phthalocyanine, which was treated with methyl cellosolve or ethylene for a first polymorph; propylene glycol, 1,3-butanediol, or glycerine for a second; and aqueous mannitol solution for a third. U.S. Pat. Nos. 4,994,566 and 5,008,173, to Mimura et al, teach a process in which non-crystalline particles produced by: acid pasting or slurrying then mechanical grinding, mechanical grinding for a very long time, or sublimation; are treated with tetrahydrofuran. U.S. Pat. No. 5,055,368, to Nguyen et al, teaches a "salt-milling" procedure. U.S. Pat. Nos. 5,238,764 and 5,238,766, both to Molaire, teach that titanyl fluorophthalocyanine products of acid-pasting and salt-milling procedures, unlike unsubstituted titanyl phthalocyanine, Suffer a significant reduction in near infrared sensitivity when they are dispersed in a solvent such as methanol or tetrahydrofuran, which has a $gamma_c$ hydrogen bonding parameter value greater than 9.0. These patents further teach that this reduction in sensitivity can be preserved by first contacting the titanyl fluorophthalocyanine with a material having a $gamma_c$ hydrogen bonding parameter of less than 8.0.

Electrophotographic recording elements containing phthalocyanine pigments as charge-generation materials are useful in electrophotographic laser printers because they are capable of providing good photosensitivity in the near infrared region of the electromagnetic spectrum, that is in the range of 700–900 nm. In grey level digital electrophotography, and especially in laser imaging, it is very important to match the photoconductor sensitivity to the writing system. This is not a simple problem. Consideration must be given to such #actors as laser output energy, laser spot size, gray scale power levels, and temporal stability of the laser beam. The sensitivity of titanyl fluorophthalocyanine containing photoconductors can be adjusted. One way is by first selecting a charge generation material and them varying the thickness of the layer that contains that material. The photosensitivity is raised by increasing the thickness of the layer containing the charge generation material and lowered by reducing the thickness. This approach has limited utility, however, since it is only practical for a very narrow range of thicknesses. An excessively thin layer will not absorb enough light to permit charge erasure during an electrophotographic cycle. An excessively thick layer will not transport charges well. There is a further problem. This approach requires very close tolerances on the thickness of the layer containing the charge generating material. In manufacturing, such tolerances are likely to lead to greatly increased costs.

Another way of varying the sensitivity of titanyl fluorophthalocyanine containing photoconductors is by using a mixture of two different phthalocyanines. A number of references teach combining different titanyl phthalocyanines Different combinations of titanyl phthalocyanines have produced widely differing results.

U.S. Pat. No. 4,882,427, to Enokida et al, teaches that noncrystalline or pseudo-noncrystalline phthalocyanine products produced from various mixtures of crude phthalocyanines had sensitivities about the same as that of a noncrystalline titanyl phthalocyanine.

U.S. Pat. No. 5,112,711, to Nguyen et al, teaches an electrophotographic element having a combination of titanyl phthalocyanine and titanyl fluorophthalocyanine. In U.S. Pat. No. 5,112,711, a combination of titanyl phthalocyanine and titanyl fluorophthalocyanine provided a synergistic increase in photosensitivity, while combinations of titanyl phthalocyanine and chloro- or bromo-substituted titanyl phthalocyanine produced results in which the photosensitivity was nearer that of the least sensitive phthalocyanine.

U.S. Pat. No. 5,039,586, to Itami, teaches that a photoreceptor could be made having a mixture of such crystalline forms of titanylphthalocyanine, as α-TiOPc, β-TiOPc, mixed α- and β-, and amorphous TiOPc but does not indicate what electrophotographic characteristics would result.

*Organic Photoreceptors for Imaging Systems,* P. M. Borsenberger and D. S. Weiss, Marcel Dekkar, Inc., New York, at page 365, summarizes a number of reports of enhanced sensitivities for photoreceptors having charge generation layers containing mixtures of two phthalocyanines.

There is a continuing need for electrophotographic elements having various photosensitivities. It is highly desirable to provide improved electrophotographic elements including more than one type of titanyl fluorophthalocyanine and providing various photosensitivities.

SUMMARY OF THE INVENTION

The invention, in its broader aspects, provides an electrophotographic element and a preparation method. The element has a charge generation layer including binder and, dispersed in the binder, a physical mixture of: a high speed titanyl fluorophthalocyanine and a low speed titanyl fluorophthalocyanine. The high speed titanyl fluorophthalocyanine has a first intensity peak with respect to X-rays characteristic of Cu Kα at a wavelength of 1.541 Å of the Bragg angle 2θ at 270°±0.2° and a second intensity peak at 7.3°±0.2°. The second peak has an intensity relative to the first peak of less than 60 percent. The low speed titanyl fluorophthalocyanine has a first intensity peak with respect to X-rays characteristic of Cu Kα at a wavelength of 1.541 Å of the Bragg angle 2θ at 6.7°±0.2° and a second intensity peak at 23.7°±0.2. The second peak has an intensity relative to the first peak of less than 50 percent.

It is an advantageous effect of at least some of the embodiments of the invention that improved electrophotographic elements are provided that include more than one type of titanyl fluorophthalocyanine and provide various photosensitivities.

BRIEF DESCRIPTION OF THE FIGURES

The above mentioned and other features and objects of this invention and the manner of attaining them will become more apparent and the invention itself will be better understood by reference to the following description of an embodiment of the invention taken in conjunction with the accompanying figures wherein.

DESCRIPTION OF PARTICULAR EMBODIMENTS

In the method of the invention, two different titanyl fluorophthalocyanine pigments are mixed to provide the titanyl fluorophthalocyanine charge generation material of the invention, which has novel characteristics. The charge generation material, along with the remaining components of a coating composition, is coated to form the charge generation layer of an electrophotographic recording element of the invention.

It is a common practice for those in the art to refer to the product of a phthalocyanine preparation procedure as a "pigment". This practice is followed herein.

The two different titanyl fluorophthalocyanine pigments used in the method of the invention are referred to herein as "low speed titanyl fluorophthalocyanine pigment" or "low speed pigment" and "high speed titanyl fluorophthalocyanine pigment" or "high speed pigment". The low and high speed pigments have different speeds or sensitivities, as discussed below in detail.

The low speed titanyl fluorophthalocyanine has a first intensity peak with respect to X-rays characteristic of Cu Kα at a wavelength of 1.541 Å of the Bragg angle 2θ at 6.7 and a second intensity peak at 23.7. The second peak has an intensity relative to the first peak of less than 50 percent. Crystallographic characteristics discussed herein, are based upon X-ray diffraction spectra at the Bragg angle 2(theta) using Cu Kα X-radiation at a wavelength of 1.541A and are ±0.2 unless otherwise indicated. Suitable X-ray diffraction techniques are described, for example, in *Engineering Solids,* T. S. Hutchinson and D. C. Baird, John Wiley and Sons, Inc., 1963 and *X-ray Diffraction Procedures for Polycrystalline and Amorphous Materials,* 2nd Ed., John Wiley and Sons, Inc., 1974. The low speed pigment has an electrophotographic speed, determined as described bellow, in the range of from 15 to 90 ergs/cm$^2$; or preferably from 25 to 80 ergs/cm$^2$.

The high speed titanyl fluorophthalocyanine has a first intensity peak with respect to X-rays characteristic of Cu Kα at a wavelength of 1.541 Å of the Bragg angle 2θ at 27 and a second intensity peak at 7.3. The second peak has an intensity relative to the first peak of less than 60 percent. The high speed pigment has an electrophotographic speed, determined as described below, in the range of from 1.5 to 10 ergs/cm$^2$ ; or preferably from 1.5 to 4 ergs/cm$^2$.

In the method of the invention, the low and high speed pigments are mixed so as to provide a desired ratio of low to high pigment. The method of the invention is not limited to low and high speed pigments that are "pure" or substantially "pure". It is not critical to the invention that a pigment could be further purified. For example, a low speed pigment could include a percentage of high speed pigment as a contaminant. This would limit the range of speeds available on mixing low and high speed pigments, but would not otherwise present a problem.

Figure 4:
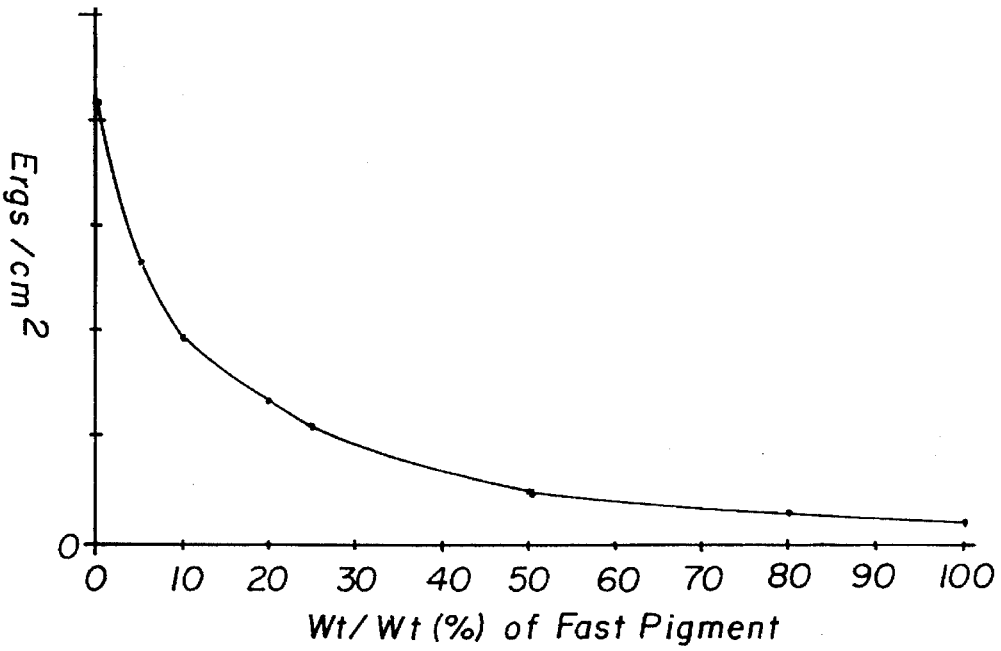
FIG. 4 is a graph of photosensitivity or speed in ergs/cm$^2$ vs. the weight fraction of fast pigment in the electrophotographic elements of the examples and comparative examples.

The electrophotographic elements of the invention have a sensitivity or speed that reflects the combination of low speed and high speed pigments. Surprisingly, unlike previously reported combinations of fluorophthalocyanine pigments, the electrophotographic elements of the invention do not show a net increase in sensitivity nor do they show about the same sensitivity as either of the two different pigments. The electrophotographic recording elements of the invention instead demonstrate sensitivities which are somewhere between the speeds of elements prepared using only high or low speed pigment. The sensitivities are not additive of the expected speeds for the relative weight fractions of the low speed and high speed pigments, but instead follow a more complex function. An example of a graph of that function for a particular embodiment of the invention is shown in FIG. 4 and discussed below in relation to the examples.

The method of preparation of the low speed and high speed titanyl fluorophthalocyanine pigments is not critical to the practice of the invention as long as the pigment produced has an appropriate x-ray spectrum and meets the ordinary requirements of electrophotographic use, in terms of dispersibility, contaminants, and the like. In a preferred embodiment of the invention, the low and high speed pigments are produced by procedures in which crude pigment is first rendered amorphous and then is treated with a solvent having a high $gamma_c$ hydrogen bonding parameter, to prepare low speed pigment; or with a solvent having a low $gamma_c$ hydrogen bonding parameter, to prepare high speed pigment, It is currently preferred that the high $gamma_c$ be 10 or greater and that the low $gamma_c$ be 7 or less.

$Gamma_c$ hydrogen bonding parameter values of organic solvents can be determined by the method reported in "A Three-Dimensional Approach to Solubility", J. D. Crowley, G. S. Teague, and J. W. Lowe, *Journal of Paint Technology,* Vol. 38, No. 496, May 1966, pp. 269–280, and further described in *CRC Handbook of Solubility Parameters and Other Cohesion Parameters,* A. Barton, CRC Press, Boca Raton,m Fla., 1983, pp. 174 and 179–180, and in the ASTM D3132 standard test method. The method comprises measuring the effect of the solvent on deuterated methanol in terms of the frequency of the infrared radiation absorbed by the O-D bond of deuterated methanol and comparing that effect to the effect of benzene on the same bond. The value of the $gamma_c$ hydrogen bonding parameter for the solvent being tested is then determined in accordance with the equation:

$$gamma_c=\{(nu_{benzene})-(nu_{solvent})\}/10$$

where "$nu_{benzene}$" is the wave number (expressed as $cm^{-1}$) of the infrared radiation absorbed by the O-D bond of deuterated methanol in contact with benzene, and "$nu_{solvent}$" is the wave number of the infrared radiation absorbed by the O-D bond of deuterated methanol in contact with the solvent being tested.

$Gamma_c$ hydrogen bonding parameter values of numerous organic solvents have been determined. A list for some common solvents is presented in Table 1.

TABLE 1

| Solvent | $Gamma_c$ hydrogen bonding parameter value |
|---|---|
| benzene | 0.0 |
| dichloromethane | 1.5 |
| 1,1,2-trichloroethane | 1.5 |
| chlorobenzene | 1.5 |
| dichloropropane | 1.5 |
| chloroform | 1.5 |
| ethylene chloride | 1.5 |
| toluene | 4.5 |
| xylene | 4.5 |
| acetonitrile | 6.3 |

TABLE 1-continued

| Solvent | $Gamma_c$ hydrogen bonding parameter value |
|---|---|
| methyl benzoate | 6.3 |
| anisole | 7.0 |
| diethyl ketone | 7.7 |
| methyl ethyl ketone | 7.7 |
| methyl isobutyl ketone | 7.7 |
| acetone | 9.7 |
| butylrolactone | 9.7 |
| dioxane | 9.7 |
| tetrahydrofuran | 9.9 |
| cyclohexanone | 11.7 |
| N,N-dimethylformamide | 11.7 |
| 2-ethoxyethanol | 13.0 |
| ethanol | 18.7 |
| methanol | 18.7 |
| butanol | 18.7 |
| pyridine | 18.1 |
| ethylene glycol | 20.6 |

The low speed pigment can be one of the pigments produced by methods disclosed in U.S. Pat. Nos. 5,238,764 and5,238,766, both to Molaire, both of which are hereby incorporated herein by reference, in which crude pigment is salt milled or acid pasted followed by dispersion in a solvent such as methanol or tetrahydrofuran, which has a $gamma_c$ hydrogen bonding parameter value greater than 9.0. The low speed pigment can alternatively be the pigment referred to as "low(dm)-$TiOF_nPc$" titanyl fluorophthalocyanine in a U.S. patent application Ser. No. 08/330,395 abandoned, entitled: METHODS FOR PREPARING TITANYL FLUOROPHTHALOCYANINES BY DRY MILLING, ELECTROPHOTOGRAPHIC ELEMENTS, AND TITANYL FLUOROPHTHALOCYANINE COMPOSITIONS, filed by Michel F. Molaire concurrently with this application, which is hereby incorporated herein by reference.

The high speed pigment can be one of the pigments produced by methods disclosed in U.S. Pat. Nos. 5,238,764 and 5,238,766, both to Molaire, both of which are hereby incorporated herein by reference, in which crude pigment is salt milled or acid pasted followed by contacting, prior to any other solvent contact, the pigment with a material that has a $gamma_c$ hydrogen bonding parameter value of less than 8.0. The high speed pigment can alternatively be the pigment referred to as "high(dm)-$TiOF_nPc$" titanyl fluorophthalocyanine in a U.S. patent application Ser. No. 08/330,395 entitled: METHODS FOR PREPARING TITANYL FLUOROPHTHALOCYANINES BY DRY MILLING, ELECTROPHOTOGRAPHIC ELEMENTS, AND TITANYL FLUOROPHTHALOCYANINE COMPOSITIONS, filed by Michel F. Molaire concurrently with this application. The high speed pigment used in the invention can also be a mixture of pigments, each of which demonstrates the characteristic x-ray peaks above indicated.

Suitable high and low speed titanyl fluorophthalocyanines are also disclosed in a U.S. patent application Ser. No. 08/330,396 entitled: METHOD FOR PREPARING TITANYL FLUOROPHTHALOCYANINES, ELECTROPHOTOGRAPHIC ELEMENTS, AND TITANYL FLUOROPHTHALOCYANINE COMPOSITIONS, filed by Michel F. Molaire et al concurrently with this application.

In the method of the invention, the low speed pigment, high speed pigment, binder and any desired addenda, are dissolved or dispersed together in a liquid to form an electrophotographic coating composition which is then coated over an appropriate underlayer. The liquid is then allowed or caused to evaporate to form the charge generation layer of the invention. As a matter of convenience, the low and high speed pigments may or may not be mixed together before addition to the coating composition.

The electrophotographic elements of the invention can be of various types, including both those commonly referred to as single layer or single-active-layer elements and those commonly referred to as multiactive, or multi-active-layer elements. All of the electrophotographic elements of the invention have multiple layers, since each element has at least an electrically conductive layer and one photogenerating (charge generation) layer, that is, a layer which includes, as a charge generation material, a composition of matter including the high and low speed pigments of tile invention.

Single-active-layer elements are so named because they contain only one layer, referred to as the photoconductive layer, that is active both to generate and to transport charges in response to exposure to actinic radiation. Such elements have an additional electrically conductive layer in electrical contact with the photoconductive layer. In single-active-layer elements of the invention, the photoconductive layer contains the charge generation material of the invention, which generates electron/hole pairs in response to actinic radiation and an charge-transport material, which is capable of accepting the charges and transporting them through the layer to effect discharge of the initially uniform electrostatic potential. The charge-transport agent, and low and high speed pigments are dispersed as uniformly as possible in the photoconductive layer. The photoconductive layer also contains an electrically insulative polymeric film-forming binder. The photoconductive layer is electrically insulative except when exposed to actinic radiation.

Multiactive layer elements are so named because they contain at least two active layers, at least one of which is capable of generating charge, that is, electron/hole pairs, in response to exposure to actinic radiation and is therefore referred to as a charge-generation layer (CGL), and at least one of which is capable Of accepting and transporting charges generated by the charge-generation layer and is therefore referred to as a charge-transport layer (CTL). Such elements typically comprise at least an electrically conductive layer, a CGL, and a CTL. Either the CGL or the CTL is in electrical contact with both the electrically conductive layer and the remaining CTL or CGL. The CGL contains a polymeric binder, and the charge generation material of the invention: low and high speed pigment. The CTL contains a charge-transport agent and a polymeric binder.

Single-active-layer and multiactive layer electrophotographic elements and their preparation and use in general, are well known and are described in more detail, for example, in U.S. Pat. Nos. 4,701,396; 4,666,802; 4,578,334; 4,719,163; 4,175,960; 4,514,481; and 3,615,414, the disclosures of which are incorporated herein by reference.

In preparing the electrophotographic elements of the invention, the components of the photoconductive layer (in single-active-layer elements) or CGL (in multiactive layer elements), including binder and any desired addenda, are dissolved or dispersed together in a liquid to form an electrophotographic coating composition which is then coated over an appropriate underlayer, for example, a support or electrically conductive layer. The liquid is then allowed or caused to evaporate from the mixture to form the permanent photoconductive layer or CGL. The titanyl fluorophthalocyanine pigment can be mixed with the solvent solution of polymeric binder immediately or can be stored for some period of time before making up the coating composition.

The polymeric binder used in the preparation of the coating composition can be any of the many different binders that are useful in the preparation of electrophotographic layers. The polymeric binder is a film-forming polymer having a fairly high dielectric strength. In a preferred embodiment of the invention, the polymeric binder also has good electrically insulating properties. The binder should provide little or no interference with the generation and transport of charges in the layer. The binder can also be selected to provide additional functions. For example, adhering a layer to an adjacent layer; or, as a top layer, providing a smooth, easy to clean, wear-resistant surface. Representative binders are film-forming polymers having a fairly high dielectric strength and good electrically insulating properties. Such binders include, for example, styrene-butadiene copolymers; vinyl toluene-styrene copolymers; styrene-alkyd resins; silicone-alkyd resins; soya-alkyd resins; vinylidene chloride-vinylchloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; poly (methylstyrene); isobutylene polymers; polyesters, such as poly(ethylenecoakylenebis(alkyleneoxyaryl) phenylenedicarboxylate); phenol-formaldehyde resins; ketone resins; polyamides; polycarbonates; polythiocarbonates; poly{ethylen-coisopeopyliden- 2,2-bis(ethylenoxyphenylene)terephthalate}; copolymers of vinyl haloacrylates and vinyl acetate such as poly(vinyl-m-bromobenzoatecovinyl acetate); chlorinated poly(olefins), such as chlorinated poly(ethylene); cellulose derivatives such as cellulose acetate, cellulose acetate butyrate and ethyl cellulose; and polyimides, such as poly{1,1,3-trimethyl- 3-(4'-phenyl)-5-indane pyromellitimide}. Examples of binder polymers which are particularly desirable from the viewpoint of minimizing interference with the generation or transport of charges include: bisphenol A polycarbonates and polyesters such as poly[(4,4'-norbomylidene)diphenylene terephthalate-coazelate].

Suitable organic solvents for forming the polymeric binder solution can be selected from a wide variety of organic solvents, including, for example, aromatic hydrocarbons such as benzene, toluene, xylene and mesitylene; ketones such as acetone, butanone and 4-methyl-2-pentanone; halogenated hydrocarbons such as dichloromethane, trichloroethane, methylene chloride, chloroform and ethylene chloride; ethers including ethyl ether and cyclic ethers such as dioxane and tetrahydrofuran; other solvents such as acetonitrile and dimethylsulfoxide; and mixtures of such solvents. The amount of solvent used in forming the binder solution is typically in the range of from about 2 to about 100 parts of solvent per part of binder by weight, and preferably in the range of from about 10 to 50 parts of solvent per part of binder by weight.

In the coating composition, the optimum ratio of the charge generation material of the invention to binder or of charge generation material plus charge transport material to binder can vary widely, depending on the particular materials employed. In general, useful results are obtained when the total concentration of both charge generation material and charge transport material in a layer is within the range of from about 0.01 to about 90 weight percent, based on the dry weight of the layer. In a preferred embodiment of a single active layer electrophotographic element of the invention, the coating composition contains from about 10 to about 70 weight percent of an electron-transport agent and from 0.01 to about 80 weight percent of the charge generation material of the invention. In a preferred embodiment of a multiple active layer electrophotographic element of the invention, the coating composition contains from about 0 to about 80 weight percent of an electron-transport agent and from 0.01 to about 50 weight percent of charge generation material of the invention.

The photosensitivity of electrophotographic elements, as discussed above, is a function of both the charge generation material and the thickness of the charge generation layer. At very low thickness, the photosensitivity of the electrophotographic element of the invention is a steep function of charge generation layer thickness. As the thickness is increased, a point is reached where photosensitivity is invariant to increase in thickness. This is advantageous for manufacturing, since tolerances in the thickness of the charge generation layer are no longer critical. In the invention, the thickness of the charge generation layer can be chosen to be well above the region of photosensitivity dependent upon charge generation layer thickness. In a preferred embodiment of the invention, the charge generation layer has such a thickness; the charge generation layer is coated at a thickness from 0.25 micron to about 5 microns, depending on the concentration of the pigment.

Polymeric binders useful for the CGL or photoconductor layer can also be used in producing a CTL. Any charge transport material can be utilized in elements of the invention. Such materials include inorganic and organic (including monomeric organic, metallo-organic and polymeric organic) materials); for example, zinc oxide, lead oxide, selenium, phthalocyanine, perylene, arylamine, polyarylalkane, and polycarbazole materials, among many others. The CTL can be solvent coated or can be produced in some other manner, for example, by vacuum deposition.

CGL's and CTL's in elements of the invention can optionally contain other addenda such as leveling agents, surfactants, plasticizers, sensitizers, contrast control agents, and release agents, as is well known in the art.

Various electrically conductive layers or supports can be employed in electrophotographic elements of the invention, for example, paper (at a relative humidity above 20 percent) aluminum-paper laminates; metal foils such as aluminum foil, zinc foil, and the like; metal plates such as aluminum, copper, zinc, brass and galvanized plates; vapor deposited metal layers such as silver, chromium, vanadium, gold, nickel, aluminum and the like; and semiconductive layers such as cuprous iodide and indium tin oxide. The metal or semiconductive layers can be coated on paper or conventional photographic film bases such as poly(ethylene terephthalate), cellulose acetate, polystyrene, etc. Such conducting materials as chromium, nickel, etc. can be vacuum-deposited on transparent film supports in sufficiently thin layers to allow electrophotographic elements so prepared to be exposed from either side.

Electrophotographic elements of the invention can include various additional layers known to be useful in electrophotographic elements in general, for example, subbing layers, overcoat layers, barrier layers, and screening layers.

The following Examples and Comparative Examples are presented to further illustrate some preferred modes of practice of the invention.

Unless otherwise indicated, all starting materials were commercially obtained. Red and near infrared photosensitivity of electrophotographic elements was evaluated by electrostatically corona-charging the element to an initial potential of −700 volts and exposing the element to a xenon flash apparatus with 129 microseconds flash duration using a narrow band pass filter with peak intensity output at 775 nm, as indicated, in an amount sufficient to photoconductively discharge the initial potential down to a level of −350 volts (50% photodischarge). Photosensitivity was measured in terms of the amount of incident actinic radiant energy (expressed in ergs/cm$^2$) needed to discharge the initial voltage down to the desired level. The lower the amount of radiation needed to achieve the desired degree of discharge, the higher is the photosensitivity of the element.

Preparation of crude titanyl tetrafluorophthalocyanine

4-Fluorophthalonitrile (38.7 grams, 0.267 mole) and titanium trichloride (20.7 grams, 0.134 mole) were suspended in 200 ml of 1-chloronaphthalene and heated to 210°–215° C. and maintained for 2.5 hours at this temperature. The reaction mixture was cooled slightly, and the dark solid was collected and washed with acetone and methanol. After drying, the dark blue solid (34 grams) was slurried twice in refluxing dimethylformamide, filtered hot each time, and washed with acetone to yield crude titanyl tetrafluorophthalocyanine.

Preparation of acid pasted titanyl tetrafluorophthalocyanine

Figure 1:
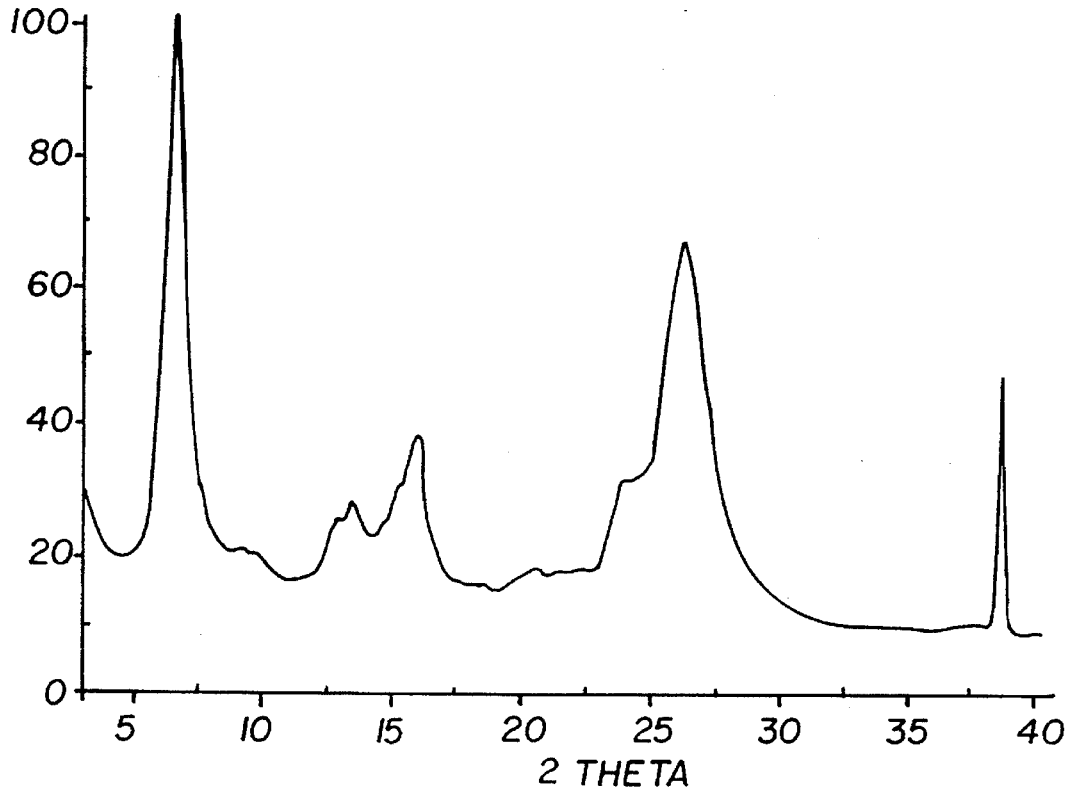
FIG. 1 is an x-ray diffraction spectrum that exhibits peaks of the Bragg angle 2θ with respect to x-rays of Cu Kα at a wavelength of 1.541 Å, for acid-pasted amorphous titanyl fluorophthalocyanine.

One kilogram of crude titanyl fluorophthalocyanine pigment was dissolved in sulfuric acid over two hours. The temperature of the solution was maintained between 9° and 21° C. The solution was then filtered through a sintered glass funnel and precipitated into water over 105 minutes. The water temperature was maintained between 24° C. and 46° C. The pigment was allowed to settle. The water was decanted, washed four times (10 liters of water each time). The pigment was then filtered from the water using a cloth filter and washed with Water until the wash water tested at neutral pH. The pigment was dried in a steam cabinet, ground by, hand, using a mortar and pestle, added to 5 liters water, heated to boiling/boiled for an hour, filtered, and repeated four times, then dried in a steam cabinet. An x-ray diffraction spectrum was taken of the product and is presented in FIG. 1.

Preparation of high speed pigment

Figure 2:
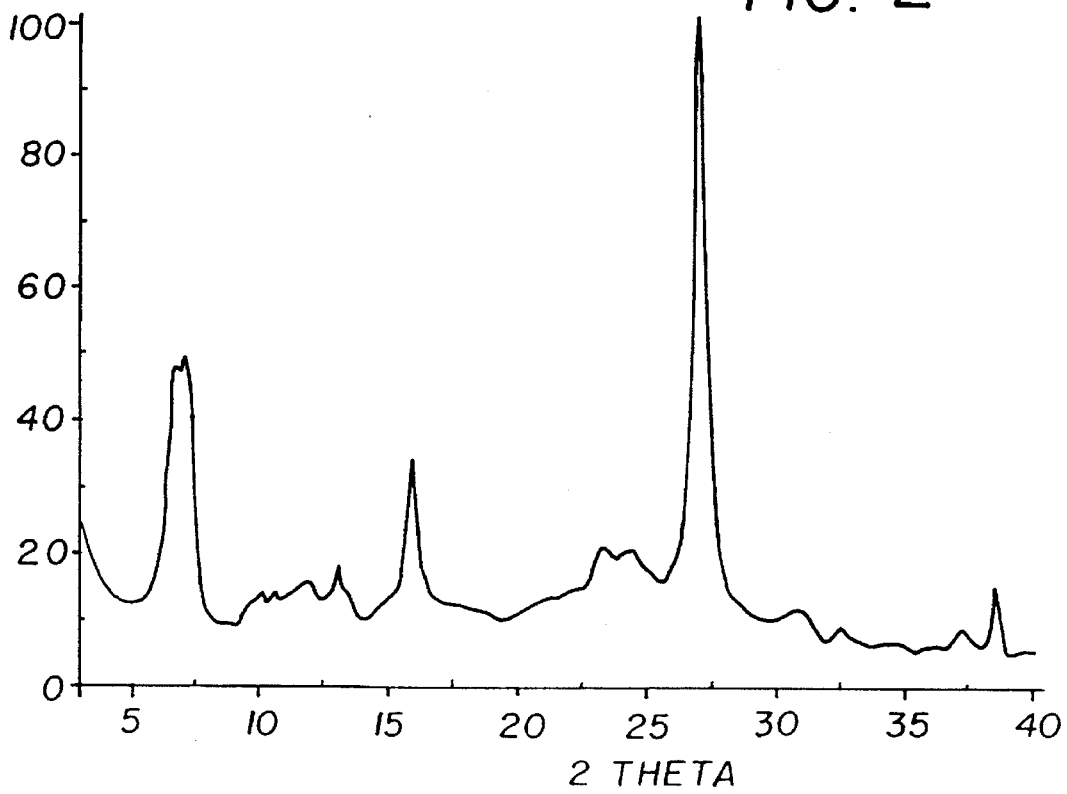
FIG. 2 is the same kind of x-ray spectrum for high speed, high crystallinity titanyl fluorophthalocyanine.

Acid-pasted pigment (16.7 grams) prepared as above-described was mixed with dichloromethane (300 grams, gamma$_c$ hydrogen bonding parameter=1.5), and 2 mm diameter stainless steel shot (300 grams), in a 12 ounce jar. The pigment was milled in a Sweco Vibro Energy Grinding mill marketed by Sweco, Inc., Florence, Ky., for 3 days and the shot was removed. The pigment was filtered, washed with dichloromethane, dried, and collected. An x-ray diffraction spectrum was taken of the high speed titanyl fluorophthalocyanine product and is presented in FIG. 2. The x-ray diffraction spectrum of FIG. 2 exhibits peaks of the Bragg angle 2θ with respect to X-rays of Cu Kα at a wavelength of 1.541A at 6.6°, 7.1°, 9.8°, 11.6°, 12.9°, 14.9°, 15.8°, 18.2°, 20.7°, 23.2°, 24.3°, 27.0°, 31.0°, 32.5°, 34.5°, and 37.1° (all ±0.2°). In terms of characteristic peaks, the high speed titanyl fluorophthalocyanine has a first intensity peak with respect to X-rays characteristic of Cu Kα at a wavelength of 1.541 Å of the Bragg angle 2θ at 27°±0.2° and a second intensity peak at 7.3°±0.2°. The 7.3° peak has an intensity relative to the 27° peak of about 60 percent.

Preparation of low speed pigment

Figure 3:
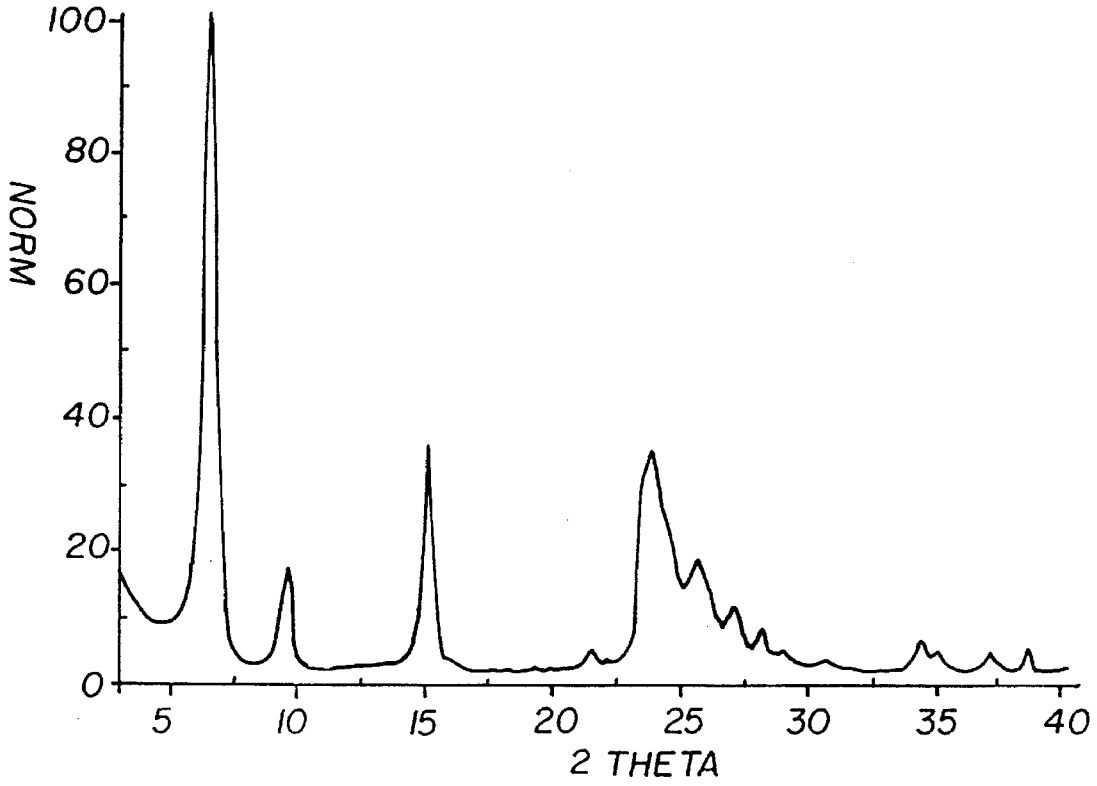
FIG. 3 is the same kind of x-ray spectrum for low speed, high crystallinity titanyl fluorophthalocyanine.

The same procedures were followed as in the preparation of high speed pigment with the exception that methanol (gamma$_c$ hydrogen bonding parameter=18.7) was used in place of dichloromethane. The x-ray diffraction spectrum taken of the low speed pigment, shown in FIG. 3, exhibits peaks of the Bragg angle 2θ with respect to X-rays of Cu Kα at a wavelength of 1.541 Å at 6.6°, 9.4°, 13.0°, 15.0°, 21.3°, 23.4°, 24.3°, 25.3°, 26.9°, 27.9°, 28.9°, 30.6°, 34.1°, 34.7°, 36.7° (all ±0.2°). In terms of characteristic peaks, the low speed titanyl fluorophthalocyanine has a first intensity peak with respect to X-rays characteristic of Cu Kα at a wavelength of 1.541 Å of the Bragg angle 2θ at 6.7°± 0.2° and a second intensity peak at 23.7°±0.2°. The 23.7° peak has an intensity relative to the 6.7° peak of about 30 percent.

EXAMPLES 1–6

Electrophotographic elements were prepared using, as a support, a 175 micron thick conductive support comprising a thin layer of aluminium on poly(ethylene terephtalate) substrate. The film was, as indicated below, using a hopper coating machine. The bare film was first undercoated with a barrier layer of polyamide resin, (2% weight/weight solution in mathanol solvent) marketed by Toray Industries Inc, of Japan as Amilan CM8000 with the hopper coating machine set at an application rate of 0.05 grams(dry)/ft$^2$.

High and low speed pigments, in the amounts indicated in Table 1, were mixed with polyester formed from 4,4'-(2-norbornylidene)diphenol and a 4‰ molar ratio of terephthalic/Azelaic acids; (1.02 grams), tetrahydrofuran (117 grams), and 2 mm diameter steel shot (117 grams), in a 12 ounce glass jar, and milled in a Sweco mill for 3 days. The pigment dispersion was then freed of the steel shot. The steel shot was washed with tetrahydrofuran (60 grams). The tetrahydrofuran wash was added back into the pigment dispersion.

The pigment dispersion was then added to a previously prepared mixture of polyester formed from 4,4'-(2-norbornylidene)diphenol and a 4‰ molar ratio of terephthalic/Azelaic acids (1.04 grams), 1,1-bis{4-(di- 4-tolylamino)phenyl)cyclohexane, a charge transport material (0.246 grams), tri-4-tolylamine, another charge transport material (0.246 grams), tetrahydrofuran (81.76 grams), and 0.06 grams of a siloxane surfactant sold under the trademark, DC510, by Dow Corning, U.S.A. The resulting mixture was filtered through an 8 micron filter to provide a coating composition of the invention.

The coating composition was coated on the undercoated film using the hopper coating machine operated at 0.05 grams(dry)/ft$^2$ to form a charge generation layer (CGL).

A charge transport layer CTL was applied over the CGL using a solution of polyester formed from 4,4'-( 2-norbornylidene)diphenol and a 4‰ molar ratio of terephthalic/Azelaic acids 6 parts by weight, 1,1-bis{4-(di-4-tolylamino)phenyl}cyclohexane 2 parts by weight, and ri-4-tolylamine 2 parts by weight, dissolved in dichloromethane solvent. The hopper coating machine setting was 2.3 grams-(dry)/ft$^2$.

The resulting electrophotographic elements were then evaluated as follows. Red and near infrared photosensitivity of the charge generation layers was determined by electrostatically corona-charging the electrophotographic element to an initial potential of −700 volts and exposing the element to 150 microsecond flash of a Xenon lamp mounted with a narrow band pass filter with peak intensity at 775 nm, in an amount sufficient to photoconductively discharge the initial potential down to a level of −350 volts. Photosensitivity (also referred to as "photographic speed" or "speed") was measured in terms of the amount of incident actinic radiant energy (expressed in ergs/cm$^2$) needed to discharge the initial voltage down to the desired level of −350 volts. The lower the amount of radiation needed to achieve the desired degree of discharge, the higher is the photosensitivity of the element. Dark decay was determined by charging the element to −700 volts in the dark and wait seven seconds before measuring the surface potential; the decrease in surface potential is divided by seven to calculate the dark decay in volts/second. Results appear in Table 2 and FIG. 4.

COMPARATIVE EXAMPLES 1–2

The procedures of Examples 1–6 were repeated except only low speed pigment was used in Comparative Example 1 and only high speed pigment was used in Comparative Example 2. Results appear in Table 2 and FIG. 4.

TABLE 2

| Ex or Comp. Ex | High speed pigment (grams) | Low speed pigment (grams) | fast pigment (wt./wt %) | Speed (ergs/cm$^2$ at 50%) | Dark decay (volts/sec) |
|---|---|---|---|---|---|
| C Ex 1 | 0 | 4.08 | 0 | 41.7 | 3.6 |
| Ex 1 | 0.204 | 3.876 | 5 | 26.3 | 2.9 |
| Ex 2 | 0.408 | 3.672 | 10 | 19.1 | 3.6 |
| Ex 3 | 0.816 | 3.226 | 20 | 13.2 | 3.6 |
| Ex 4 | 1.02 | 3.06 | 25 | 10.7 | 3.6 |
| Ex 5 | 2.04 | 2.04 | 50 | 5 | 5 |
| Ex 6 | 3.226 | 0.816 | 80 | 2.9 | 3.6 |
| C Ex 2 | 4.08 | 0 | 100 | 2.5 | 2.6 |

Referring to Table 2, it is notable that the speeds of 50 and 80 percent high speed pigment (i.e. weight of high speed/weight of high and low speed pigments) are close to the speed of 100 percent high speed pigment. This is surprising and also very advantageous, since it means that an electrophotographic element can be provided that has a selected high speed within a particularly useful range by ordinary preparation methods. Small changes in relative concentrations of high and low speed pigments produce minor changes in speed.

Additional electrophotographic elements, incorporating high speed and low speed pigments prepared by different procedures produced comparable results to those described in the Examples.

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

What is claimed is:

1. An electrophotographic element comprising a charge generation layer including binder and, dispersed in said binder, a physical mixture of:

a high speed titanyl fluorophthalocyanine having a first intensity peak with respect to X-rays characteristic of Cu Kα at a wavelength of 1.541 Å of the Bragg angle 2θ at 27°±0.2° and a second intensity peak at 7.3°±0.2°, said second peak having an intensity relative to said first peak of less than 60 percent; and a low speed titanyl fluorophthalocyanine having a first intensity peak with respect to X-rays characteristic of Cu Kα at a wavelength of 1.541 Å of the Bragg angle 2θ at 6.7°±0.2° and a second intensity peak at 23.7°±0.2°, said second peak having an intensity relative to said first peak of less than 50 percent.

2. The electrophotographic element of claim 1 wherein said charge generation layer has a red and near infrared photosensitivity between the photosensitivities of (A) charge generation layers having only said high speed pigment and (B) charge generation layers having only said low speed pigment; wherein said photosensitivity is determined by electrostatically corona-charging to an initial potential of −700 volts and exposing to monochromatic light at a wavelength of 775 nm, in an amount sufficient to photoconductively discharge the initial potential down to a level of −350 volts.

3. The electrophotographic element of claim 1 wherein said element is a single active layer element.

4. The electrophotographic element of claim 1 wherein said element is a multiple active layer element.

5. The electrophotographic element of claim 1 wherein said high speed titanyl fluorophthalocyanine has a second peak having an intensity relative to said first peak of less than 50 percent.

6. The electrophotographic element of claim 1 wherein said high speed titanyl fluorophthalocyanine has been prepared by rendering crude titanyl fluorophthalocyanine at least substantially amorphous, then contacting the pigment, prior to any other solvent contact, with a material that has a $gamma_c$ hydrogen bonding parameter value of less than 8.

7. The electrophotographic element of claim 6 wherein said low speed titanyl fluorophthalocyanine has been prepared by rendering crude titanyl fluorophthalocyanine at least substantially amorphous, then contacting the pigment, prior to any other solvent contact, with a material that has a $gamma_c$ hydrogen bonding parameter value of greater than 9.

8. An electrophotographic element comprising a support, a conductive layer, and a charge generation layer, said charge generation layer including binder and a mixture of:

a high speed titanyl fluorophthalocyanine having a first intensity peak with respect to X-rays characteristic of Cu Kα at a wavelength of 1.541 Å of the Bragg angle 2θ at 27°±0.2° and a second intensity peak at 7.3°±0.2°, said second peak having an intensity relative to said first peak of less than 60 percent; and a low speed titanyl fluorophthalocyanine having a first intensity peak with respect to X-rays characteristic of Cu Kα at a wavelength of 1.541 Å of the Bragg angle 2θ at 6.7°±0.2° and a second intensity peak at 23.7°±0.2°, said second peak having an intensity relative to said first peak of less than 50 percent;

said high speed titanyl fluorophthalocyanine and said low speed titanyl fluorophthalocyanine each having the general structure:

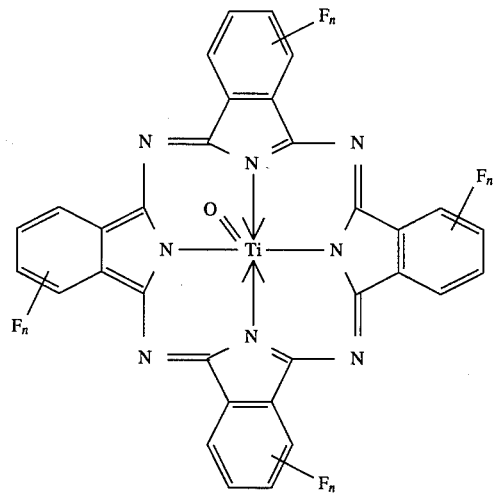

wherein each n is independently an integer from 1 to 4.

9. The electrophotographic element of claim 8 wherein said high speed titanyl fluorophthalocyanine has a second peak having an intensity relative to said first peak of less than 50 percent.

10. The electrophotographic element of claim 9 wherein said mixture has a relative weight/weight ratio of said fast titanyl fluorophthalocyanine to said slow titanyl fluorophthalocyanine of from about 40:60 to 99:1.

11. A coating composition comprising a mixture of:

a fast titanyl fluorophthalocyanine having a first intensity peak with respect to X-rays characteristic of Cu Kα at a wavelength of 1.541 Å of the Bragg angle 2θ at 27°±0.2° and a second intensity peak at 7.3°±0.2°, said second peak having an intensity relative to said first peak of less than 60 percent;

a slow titanyl fluorophthalocyanine having a first intensity peak with respect to X-rays characteristic of Cu Kα at a wavelength of 1.541 Å of the Bragg angle 2θ at 6.7°±0.2° and a second intensity peak at 23.7°±0.2°, said second peak having an intensity relative to said first peak of less than 50 percent; and a solvent.

12. The composition of matter of claim 11 wherein said fast titanyl fluorophthalocyanine has a second peak having an intensity relative to said first peak of less than 50 percent.

* * * * *